US005435325A

United States Patent [19]

Clapp et al.

[11] Patent Number: 5,435,325

[45] Date of Patent: Jul. 25, 1995

[54] PROCESS FOR PROVIDING TOBACCO EXTRACTS USING A SOLVENT IN A SUPERCRITICAL STATE

[75] Inventors: William L. Clapp; Barry S. Fagg, both of Winston-Salem; Michael E. Edwards, Windsor, all of N.C.

[73] Assignee: R. J. Reynolds Tobacco Company, Winston-Salem, N.C.

[21] Appl. No.: 310,413

[22] Filed: Feb. 13, 1989

Related U.S. Application Data

[63] Continuation-in-part of Ser. No. 184,518, Apr. 21, 1988, abandoned, and a continuation-in-part of Ser. No. 254,330, Oct. 6, 1988, abandoned.

[51] Int. Cl.[6] ..... A24B 15/24

[52] U.S. Cl. ..... 131/297; 131/298

[58] Field of Search ..... 131/297, 298

[56] References Cited

U.S. PATENT DOCUMENTS

| | | | |
|---|---|---|---|
| 3,136,321 | 6/1964 | Davis | 131/140 |
| 3,316,919 | 5/1967 | Green et al. | 131/143 |
| 3,398,754 | 8/1968 | Tughan | 131/143 |
| 3,424,171 | 1/1969 | Rooker | 131/143 |
| 4,068,671 | 1/1978 | Casey | 131/143 |
| 4,153,063 | 5/1979 | Roselius et al. | 131/143 |
| 4,246,291 | 1/1981 | Prasad et al. . | |
| 4,421,126 | 12/1983 | Gellatly | 131/371 |
| 4,506,682 | 3/1985 | Muller | 131/297 |
| 4,561,452 | 12/1985 | Gahrs | 131/297 |
| 4,714,617 | 12/1987 | Gahrs | 426/427 |
| 4,727,889 | 3/1988 | Niven, Jr. et al. | 131/297 |

FOREIGN PATENT DOCUMENTS

| | | |
|---|---|---|
| 280817 | 9/1988 | European Pat. Off. . |
| 1366331 | of 0000 | United Kingdom . |

OTHER PUBLICATIONS

Williams, "Extraction With Supercritical Gases", Chemical Engineering Science, vol. 36, pp. 1769–1773, 1780–1782, 1981.

*Angew. Chem. Int. Ed. Engl.,* Hubert et al., vol. 17, pp. 710–715 (1978).

Coresta Information Bulletin, Abstract 4461 (1967), Luganskaja et al., *Tabak,* SSSR, vol. 1, pp. 30–33 (1967).

*Chem. Eng. Sci.,* Williams, vol. 36, pp. 1769 and 1781 (1981).

*Primary Examiner*—Jennifer Bahr

[57] ABSTRACT

Concentrated tobacco extracts or essences are provided by first extracting water soluble components from tobacco. The aqueous extract then is contacted with supercritical carbon dioxide, and certain tobacco components in turn are extracted from the aqueous extract. Alternatively, the aqueous extract is subjected to a spray drying step, and the spray dried extract is contacted with supercritical carbon dioxide in order that certain tobacco components are extracted from the spray dried extract. The resulting extracted components are separated from the supercritical fluid in order to yield a tobacco essence. The essence has a homogeneous, viscous character and exhibits a tobacco aroma. The essence is useful as a flavoring agent for cigarettes and other smoking articles.

47 Claims, 4 Drawing Sheets

PROCESS FOR PROVIDING TOBACCO EXTRACTS USING A SOLVENT IN A SUPERCRITICAL STATE

CROSS REFERENCE TO RELATED APPLICATIONS

This is a continuation-in-part of U.S. application Ser. Nos. 184,518, filed Apr. 21, 1988, now abandoned and 254,330, filed Oct. 6, 1988, the disclosures of which are incorporated herein by reference.

BACKGROUND OF THE INVENTION

The present invention relates to tobacco extracts, and in particular to processes for providing extracted components from tobacco in a concentrated form.

Popular smoking articles such as cigarettes have a substantially cylindrical rod shaped structure and include a roll or charge of smokable material such as shreds or strands of tobacco (i.e., cut filler) surrounded by a wrapper such as paper thereby forming a tobacco rod. It has become desirable to manufacture cigarettes having cylindrical filters aligned in an end-to-end relationship with the tobacco rod. Typically, filters are manufactured from fibrous materials such as cellulose acetate and are attached to the tobacco rod using a circumscribing tipping material.

An important step in the cigarette manufacturing process involves the casing and top dressing of the smokable material. For example, a wide variety of flavors (which may include concentrated tobacco extracts) are applied to the smokable materials in order to increase the smoke quality and other such characteristics of the cigarette. As a result, there has been interest in extracting particular components from tobacco. For example, various processes for producing and using tobacco extracts, aroma oils and concentrates are proposed in U.S. Pat. No. 3,136,321 to Davis; U.S. Pat. No. 3,316,919 to Green; U.S. Pat. No. 3,424,171 to Rooker; U.S. Pat. No. 4,421,126 to Gellatly and U.S. Pat. No. 4,506,682 to Mueller. Such materials conveniently can be applied to tobacco laminae, reconstituted tobacco sheet and other engineered tobacco materials, cigarette filters and other substrates, and the like. A process for applying extracted tobacco components to smokable material is proposed in U.S. Pat. No. 4,727,889 to Niven, Jr. et al.

It would be highly desirable to provide an improved process for efficiently and effectively obtaining (i) modified tobacco material, and (ii) extracted tobacco components which have been separated from the modified tobacco material.

SUMMARY OF THE INVENTION

The present invention relates to a process for providing a tobacco extract. The process involves extracting components from tobacco material using a first solvent. The first solvent normally has a liquid form, and most preferably has an aqueous character. The resulting extracted tobacco components then are subjected to a second extraction using a second solvent. The second extraction is performed upon the extracted tobacco components while the second solvent is in a supercritical state, thereby providing extracted tobacco components within a supercritical fluid.

In one aspect of this invention, the components so extracted using the supercritical fluid then are isolated to provide a concentrated extract. Alternatively, the components extracted using the supercritical fluid are deposited onto a substrate such as tobacco or other smokable material, alumina, carbon fibers, or the like. The components extracted using the supercritical fluid also can be applied to the insoluble tobacco residue which remains after the first extraction step using the first solvent.

In another aspect of this invention, extracted tobacco components which have been subjected to the second extraction using the supercritical fluid and which are not supercritically extracted are isolated as a concentrated extract. For example, when the extracted tobacco components are within the first solvent when the supercritical extraction step is performed, the tobacco components which are not supercritically extracted can be separated from the first solvent and isolated. As another example, when the tobacco components extracted by the first solvent have that solvent removed therefrom, and thus are provided in a generally solid form, the tobacco components which are not supercritically extracted are collected. Alternatively, the tobacco components which are not supercritically extracted are deposited onto a substrate, or are applied to the insoluble tobacco residue which remains after the first extraction step.

One embodiment of the present invention involves extracting components from tobacco material using a first solvent having a liquid form. The resulting extracted components, as well as the first solvent, then are subjected to a second extraction using a second solvent. The second extraction is performed upon the extracted components and first solvent when the second solvent is in a supercritical state, thereby providing extracted tobacco components within a supercritical fluid. More particularly, the embodiment involves extracting components from tobacco material using a first solvent having an aqueous character. A second solvent is employed to extract components from the previously obtained extracted components while the extracted components are within the aqueous solvent. For example, tobacco components extracted using an aqueous solvent are subjected to extraction conditions using a supercritical fluid, and certain tobacco components within the aqueous solvent are extracted by the supercritical fluid.

In one aspect of the previously described embodiment, the supercritically extracted tobacco components are separated from the second solvent. In such an instance, the supercritically extracted components are isolated in concentrated form by reducing the pressure and/or temperature of the second solvent. In particular, the second solvent is converted from the supercritical state to the subcritical state in order to separate the extracted components from that solvent. One or more tobacco essences can be isolated thereby, depending upon the particular amount of temperature and/or pressure reduction.

In another aspect of the previously described embodiment, the liquid extract, which has had certain components thereof extracted therefrom by the supercritical fluid, is isolated (i.e., the extracted components within the liquid which are not extracted by the supercritical fluid and left behind after the supercritical extraction step are isolated). In such an instance, the first and second solvents (in particular the first solvent) are removed from the liquid extract such that the aqueously extracted components which have not been extracted by the supercritical fluid are isolated.

Another embodiment (i.e., the second embodiment) of the present invention involves extracting components from tobacco material using a first solvent having an aqueous character. The first solvent and the tobacco components extracted thereby then are subjected to a solvent removal process. Preferably, the resulting extracted components are provided in a low solvent form (e.g., in a solid form). The solid, extracted material then is subjected to a second extraction which is performed under supercritical conditions thereby providing extracted tobacco components within a supercritical fluid. More particularly, the second embodiment involves extracting components from tobacco material using a first solvent having an aqueous character. The resulting extracted components then are provided in a low solvent form (e.g., a low moisture form). Typically, the extracted components conveniently are provided in a low solvent form by using a spray drying process or other suitable process. A second solvent is employed to extract components from the previously obtained extracted components. For example, a spray dried tobacco extract is subjected to extraction conditions using a supercritical fluid, and certain components are extracted from the spray dried extract.

In one aspect of the second embodiment, the supercritically extracted spray dried material (i.e., residue) is isolated.

In another aspect of the second embodiment, the extracted components then are isolated from the second solvent or fluid. Typically, such extracted components are isolated in concentrated form by reducing the pressure and/or temperature of the second solvent. One or more tobacco essences can be isolated thereby, depending upon the particular state of temperature and/or pressure reduction.

As used herein, the term "essence" is meant to refer to a concentrated tobacco extract having a viscous, homogeneous character. A tobacco essence can have a jelly-like, semi-solid character.

As used herein, the term "supercritical" means at or above the critical point of the solvent with respect to temperature and pressure.

The process of the present invention allows the skilled artisan to obtain concentrated tobacco extracts in an efficient and effective manner. In particular, highly aromatic and flavorful tobacco extracts conveniently can be isolated from many of the resins, waxes and other lipoid materials of tobacco. Furthermore, the supercritical extraction can be performed in a relatively efficient manner in that an aqueous fraction of a tobacco extract can be extracted directly using a supercritical fluid, without removing the first tobacco extract from the aqueous solvent prior to the supercritical extraction step. On the other hand, previously extracted tobacco material which is in a concentrated or solid form can be employed in carrying out supercritical extraction steps in order to minimize or eliminate certain processing difficulties which may arise during supercritical extraction operations.

The isolated supercritical extracts of this invention are useful as flavors for cigarettes and other smoking articles. In addition, spent tobacco materials (e.g., starting materials) which have been subjected to the aqueous extraction, as well as aqueously extracted tobacco components which are not supercritically extracted (in either a solid or liquid form) can be employed in the manufacture of processed smokable materials or otherwise incorporated into cigarettes and other smoking articles.

DETAILED DESCRIPTION OF THE PREFERRED EMBODIMENTS

Figure 1:
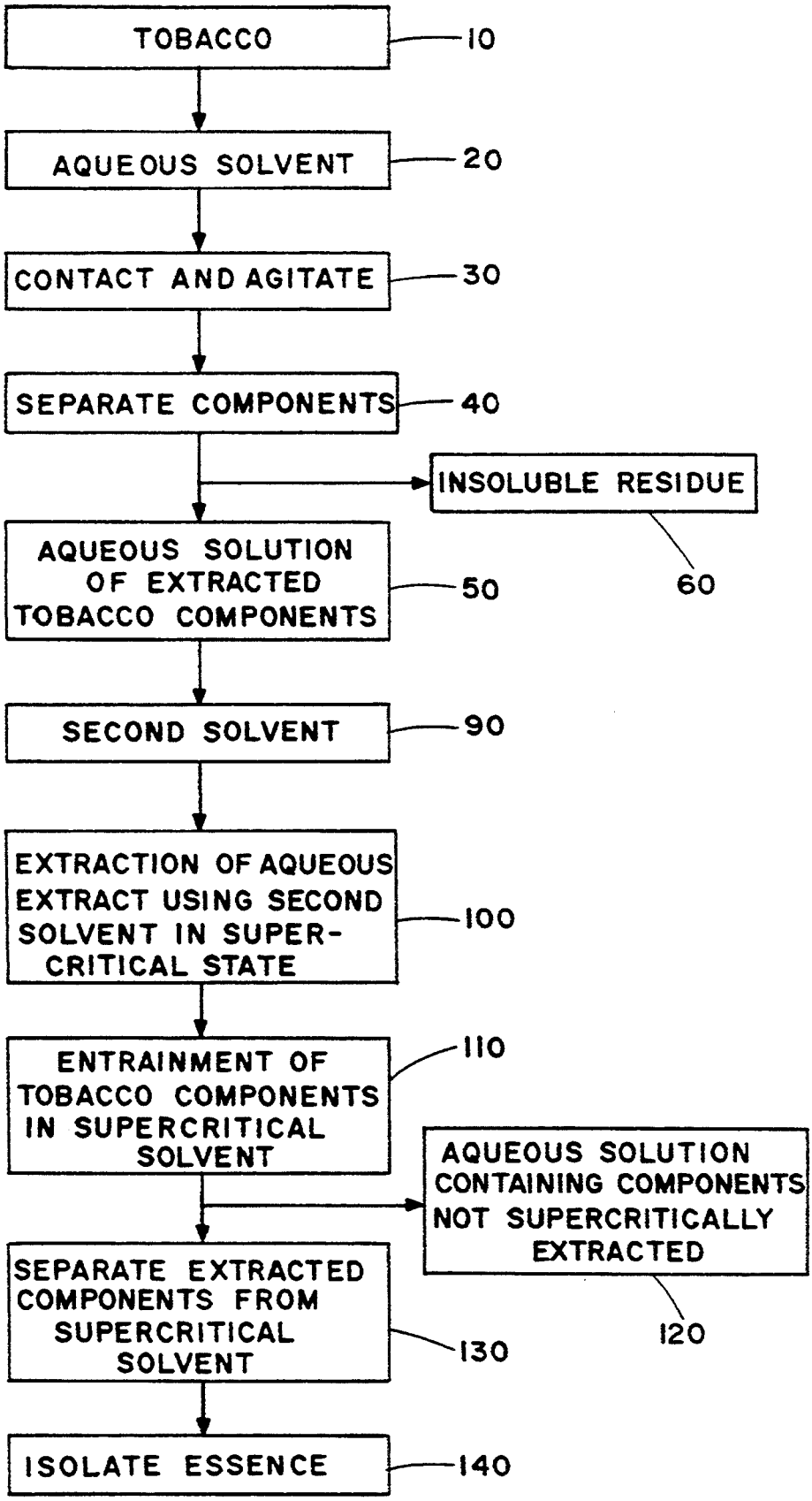
FIGS. 1 and 3 are schematic diagrams of the process steps representative of embodiments of this invention.

Referring to FIG. 1, tobacco material 10 is contacted with an aqueous solvent 20. The resulting mixture is stirred or otherwise agitated using a suitable agitation means 30. As a result, water soluble and dispersible components are extracted from the tobacco material by that solvent. The mixture is subjected to separation conditions 40 so as to provide a solution 50 of water soluble tobacco components and a water insoluble residue 60. If desired, the extracted tobacco components can be isolated from the solvent and later redissolved in the solvent. For example, an aqueous tobacco extract can be spray dried or freeze dried, and the extract later can be redissolved in water for the second extraction step.

The aqueous extract portion 50 is extracted with a second solvent 90 such as carbon dioxide, or the like, or a mixture of solvents. Extraction 100 is performed while the second solvent is a fluid in a supercritical state. As a result, certain components are extracted from the previously provided aqueous extract. Certain tobacco components are entrained in the supercritical fluid, and an aqueous solution 120 containing other water soluble tobacco components remains. The supercritical fluid and extracted components entrained therein 110 are separated from the aqueous solution 120, and are depressurized or otherwise treated so as to isolate the supercritically extracted components 130. For example, a concentrated extract 140 having the form of an essence is isolated.

Figure 2:
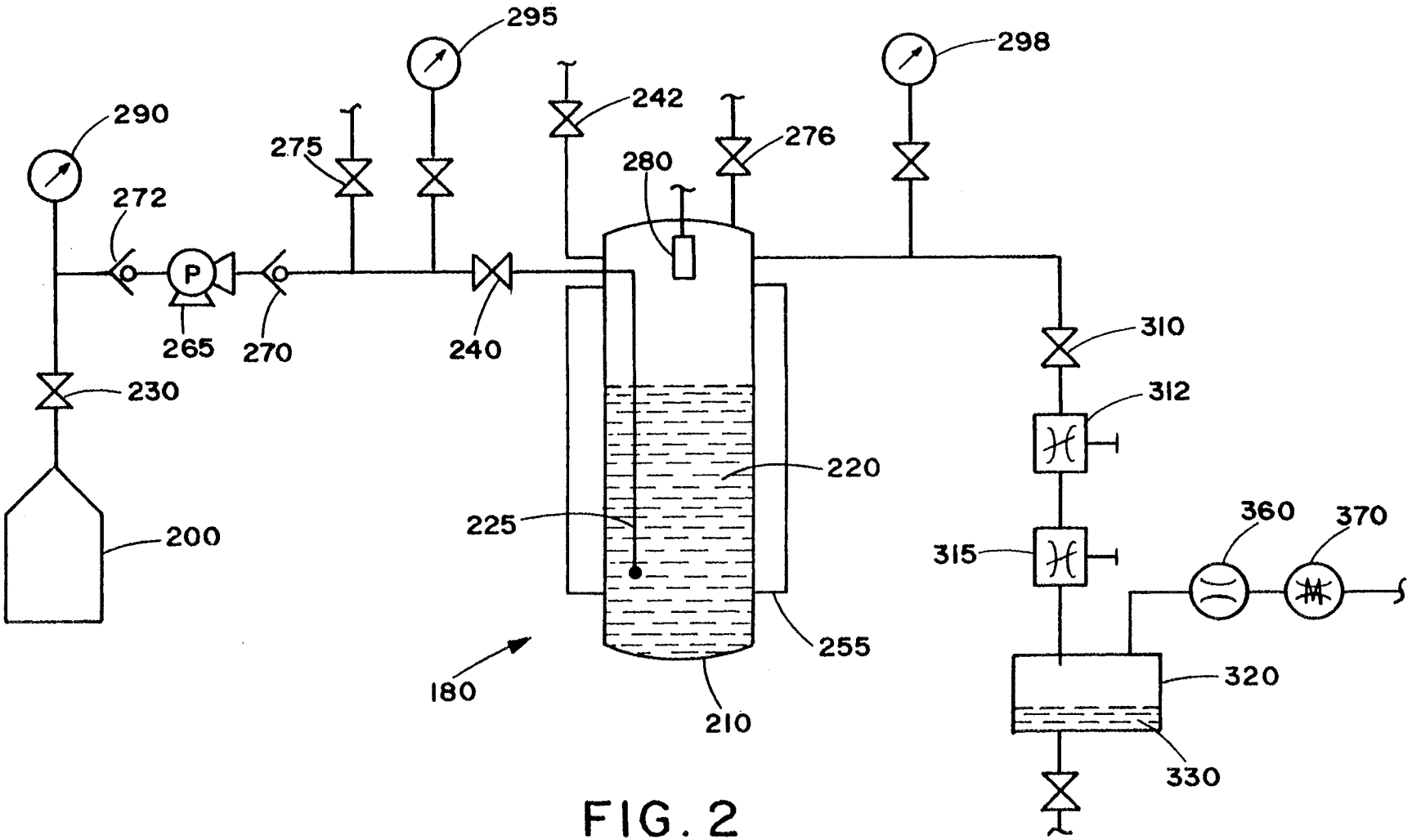
FIGS. 2 and 4 are schematic, partially cross-sectional illustrations of exemplary apparatus useful for a portion of the process of embodiments of this invention.

Referring to FIG. 2, an exemplary apparatus 180 for performing the supercritical extraction steps of this invention is shown schematically. The extraction solvent is contained in cylinder 200 and is passed to high pressure extraction vessel 210 or other suitable vessel which contains tobacco material 220 (e.g., as a liquid aqueous tobacco extract). The first solvent and extracted tobacco material contained therein 220 are contained and supported in the extraction vessel 210. The extraction vessel contains the liquid such that the liquid does not escape therefrom during the supercritical extract step; while allowing for permeation of the supercritical fluid through the liquid such that the extracted components within the liquid can come into intimate contact with the supercritical fluid. Typically, the extraction solvent is bubbled through the liquid 220 using a fritted glass tube 225 which extends into the liquid. However, it is understood that other suitable means for contacting the liquid with the supercritical fluid can be employed. Shut off valve 230 is positioned near the outlet region of the extraction solvent cylinder 200. Shut off valve 240 is positioned near the point at which the extraction solvent can enter the extraction vessel 210. Shut off valve 242 is positioned in order that the vessel 210 can be evacuated when desired. The various connecting means which connect the various components referred to, and which are shown in FIG. 2, are tubular members such as metal pipe or hose and are manufactured from pressure resistant materials.

The apparatus can include a heat exchange unit 255 which provides for heating of the second extraction solvent to the desired temperature. Other heat exchange units can be positioned at desired points throughout the apparatus. A high pressure pump 265 provides for the transfer of extraction solvent from cylinder 200 to the extraction vessel 210, pressurize the vessel and maintain the desired pressure within the vessel. The apparatus also can be equipped with check valves 270 and 272 as well as relief valves 275 and 276.

At least one thermocouple 280, or other suitable temperature sensing means is positioned within the extraction vessel 210 or elsewhere throughout the apparatus. Pressure gauge 290 is positioned between cylinder 200 and pump 265 in order to monitor the extraction solvent entering the pump 265. Pressure gauges 295 and 298 are positioned near extraction cylinder 210 in order to monitor the pressure within that cylinder.

The supercritical fluid and tobacco components extracted thereby and entrained therein is passed from vessel 210. Such passage is accomplished by opening shut off valve 310 and providing the selected positioning of metering valves 312 and 315. If desired, the regions of the apparatus in the vicinity of the valves 310, 312 and 315 can be equipped with heat exchange units (not shown). Supercritical fluid and extracted tobacco components entrained therein hence are allowed to pass into depressurization region 320 such that supercritically extracted tobacco components 330 are separated from the solvent and are collected. The solvent (now in a subcritical or gaseous state) is vented or otherwise removed from the extraction apparatus. The solvent can be collected, recirculated, and used again for a supercritical extraction step. Flow control meter 360 and flow totalizer 370 conveniently provide a means for measuring the amount of process fluid exiting the extraction cylinder, thereby allowing for the determination of the amount of solvent employed in the process step.

Selected components entrained in the second solvent can be removed from the second solvent by controlling the reduction of temperature and/or pressure of the supercritical fluid, by passing the fluid and entrained components through absorption beds, by using precipitation techniques, or the like. As such, certain selected components can be removed from the supercritical fluid, and the tobacco components remaining within the second solvent can be recombined with the liquid and initially extracted components.

Figure 3:
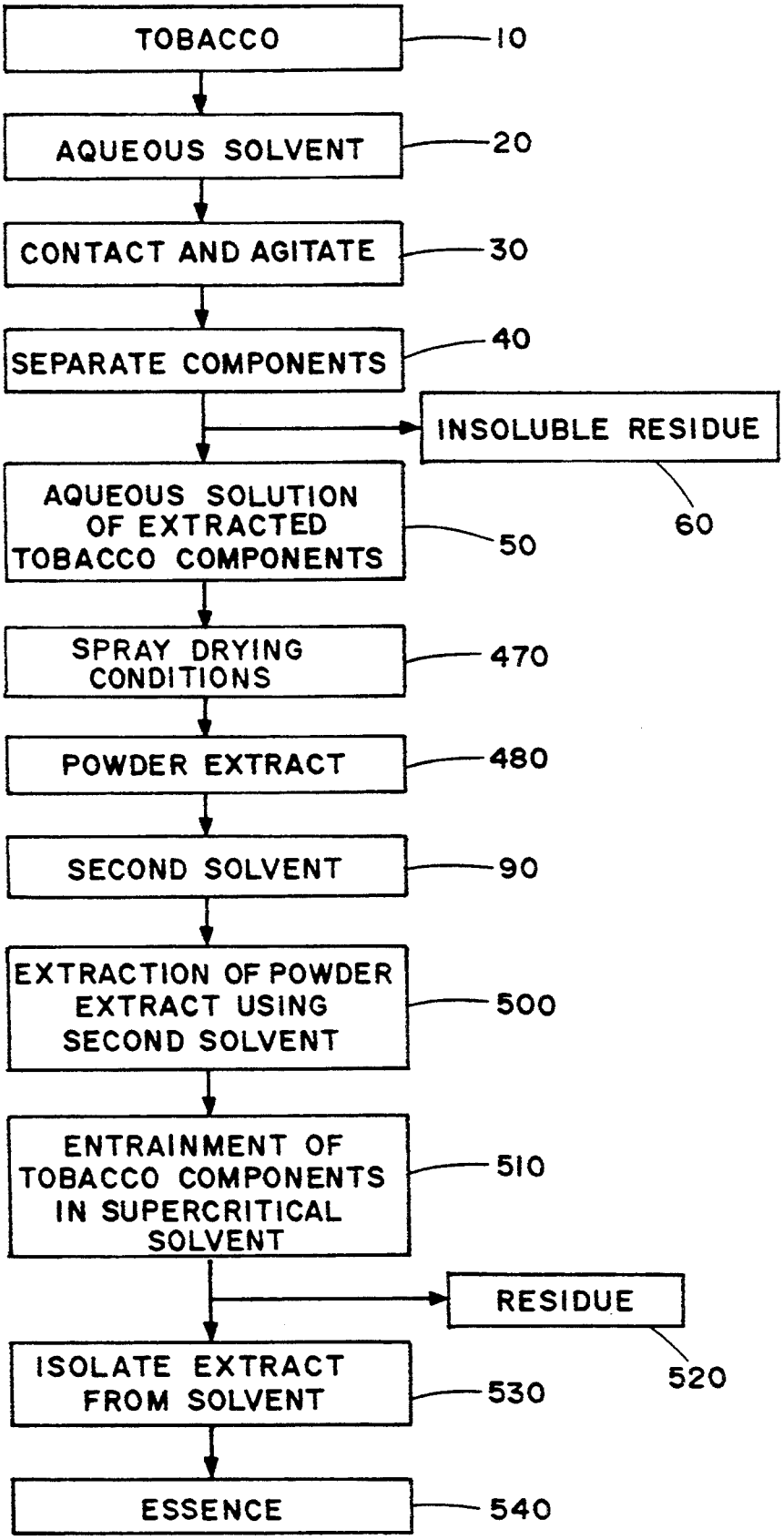

Referring to FIG. 3, tobacco material 10 is contacted with an aqueous solvent 20. The resulting mixture is stirred or otherwise agitated using a suitable agitation means 30. As a result, water soluble components are extracted from the tobacco by the solvent. The mixture is subjected to separation conditions 40 so as to provide a solution 50 of water soluble tobacco components and a water insoluble residue 60. The solution 50 then is concentrated to an appropriate solids level and then is subjected to spray drying conditions 470 so as to yield the extracted components in a low moisture form. For example, an extract having the form of a low moisture powder 480 is provided.

The powder 480 is extracted with a second solvent 90 such as carbon dioxide, or the like, or a mixture of solvents. Extraction 500 is performed while the second solvent is a fluid in a supercritical state. As a result, certain components are extracted from the previously provided extract. Tobacco components are entrained in the supercritical solvent 510 and an insoluble residue 520 remains. The supercritical fluid and extracted components entrained therein 510 are separated from the tobacco residue 520 and are depressurized or otherwise treated so as to isolate the extracted components 530. For example, a concentrated extract 540 having the form of an essence is isolated.

Figure 4:
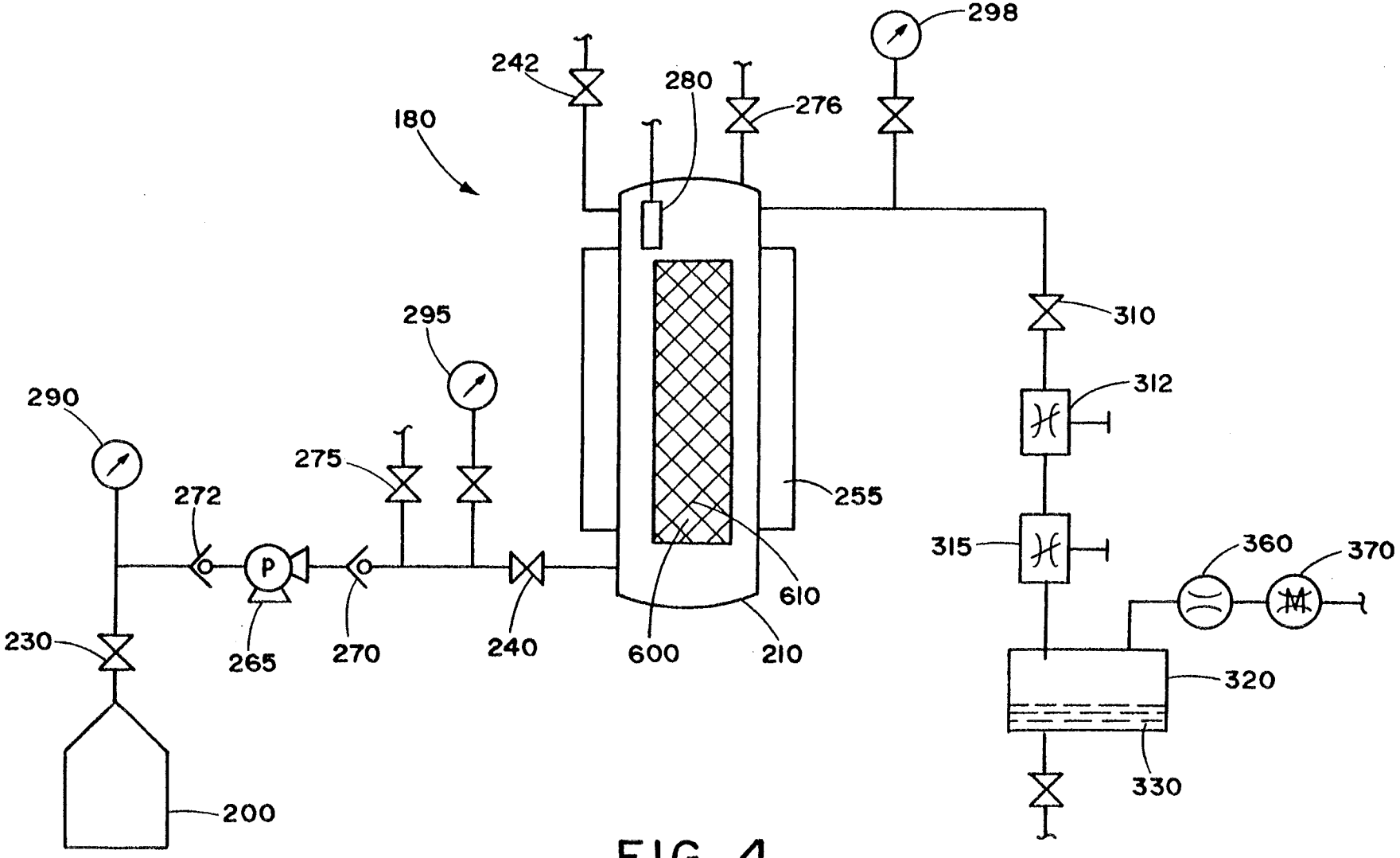

Referring to FIG. 4, an exemplary apparatus 180 for performing the supercritical extraction steps of this invention is shown. The apparatus is generally similar to the apparatus described previously with respect to FIG. 2. However, the high pressure extraction vessel 210 is adapted to contain a solid form tobacco extract 600 (e.g., a spray dried tobacco extract). The tobacco material is contained and supported in a suitable container 610 such as a vessel incorporating a suitable mesh screen to contain the low moisture form or powdered material.

The previously described apparatus 180 is exemplary of a supercritical extraction apparatus which employs an extraction solvent which is processed in a gaseous form while that solvent is in a subcritical state. However, it is understood that a supercritical extraction apparatus can be suitably equipped to employ a solvent which is processed in a liquid form while that solvent is in a subcritical state.

The tobacco material which is processed according to this invention can vary. Examples of suitable tobaccos include flue-cured, Burley, Md., and Oriental tobaccos, as well as the rare or specialty tobaccos. The tobacco material generally has been aged, and can be in the form of laminae and/or stem, or can be in a processed form. Tobacco waste materials and processing by-products such as fines, dust, scrap, stems and stalks can be employed. Unaged, uncured mature, or immature tobaccos also can be employed. The aforementioned materials can be processed separately, or as blends thereof.

The tobacco material can have a variety of sizes for the first extraction. For example, the tobacco can be in strip form or cut filler form. Tobacco materials in strip or cut filler form are desirable in that the spent materials which remain after the extraction step can be dried and further employed in the manufacture of smokable materials. Alternatively, the tobacco can be ground to a powder of fine size. Small particle size tobacco materials are desirable in order to provide for increased extraction efficiency as well as decrease the time period over which extraction may occur.

The tobacco material is contacted with a first solvent having a liquid form, and most preferably with a solvent having an aqueous character. A solvent having an aqueous character consists primarily of water, and can be essentially pure water in certain circumstances. However, the aqueous solvent can include water having substances such as pH buffers or the like dissolved therein. The solvent also can be a co-solvent mixture of water and minor amounts of one or more solvents which are miscible therewith. An example of such a co-solvent mixture is a solvent consisting of 95 parts water and 5 parts ethanol.

The amount of tobacco material which is contacted with the first solvent can vary. Typically, the weight of solvent relative to the tobacco material is greater than 6:1, oftentimes greater than 8:1 and in certain instances greater than 12:1. The amount of solvent relative to tobacco material depends upon factors such as the type of solvent, the temperature at which the extraction is performed, the type or form of tobacco which is extracted, the manner in which contact of the tobacco material and solvent is conducted, and other such factors. The manner of contacting the tobacco material and first solvent is not particularly critical.

The conditions under which the first extraction is performed can vary. Typical temperatures range from about 5° C. to about 75° C., with about 15° C. to about 30° C. being preferred, and ambient temperature being especially preferred. The solvent/tobacco material mixture can be agitated (e.g., stirred, shaken, subjected to counter-current flow, or otherwise mixed) in order to increase the rate at which extraction occurs. Typically, adequate extraction of components occurs in less than about 60 minutes, oftentimes less than about 30 minutes.

A wide variety of materials or components can be extracted from the tobacco materials. The particular materials and the amounts of the particular materials which are extracted often depend upon the type of tobacco which is processed, prior processing to which the tobacco may have been subjected, the properties of the particular solvent, and the extraction conditions (e.g., which include the temperature at which the extraction occurs as well as the time period over which an extraction is carried out). For example, a solvent consisting essentially of pure water will most often extract primarily the water soluble components of the tobacco material, while a co-solvent mixture of water and a minor amount of an alcohol can extract the water soluble components of the tobacco material as well as certain amounts of components having other solubility characteristics. Normally, for an aqueous solvent, greater than about 10 weight percent, often greater than about 25 weight percent, and frequently greater than 35 weight percent of the tobacco is extracted by the aqueous solvent.

The solvent and extracted components are separated from the insoluble residue. The manner of separation can vary; however, it is convenient to employ conventional separation means such as filtration, centrifugation, or the like. It is desirable to provide a solution of solvent and extracted components having a very low level of suspended solids while removing the greatest amount of solvent from the insoluble residue as is possible.

In one embodiment of the present invention, the first solvent and tobacco components extracted thereby are subjected to a solvent removal process such that the extracted tobacco material achieves a predominantly solid character or form. For example, solvent is removed from the extracted tobacco components at least in an amount sufficient to provide extracted components having a paste-like character. By the term "paste" is meant a material having discernible solid particles, even though the material as a whole may have some free flowing character (i.e., be fairly thick and exhibit some viscosity). Typically, predominantly solid tobacco extracts can be provided when the solvent level is reduced to below about 25 weight percent. However, predominantly solid tobacco extracts preferably are provided so as to have a solvent level of below about 20 weight percent, more preferably below about 15 weight percent. Predominantly solid tobacco extracts can have characteristics which range from that of a very dry, free-flowing powder to that of a paste. When the solvent removal processes are such that an agglomerated dry solid is provided, it is desirable to treat the solid to a grinding operation or the like to provide a finely divided solid material.

The extracted components most preferably are provided in a low solvent form. By the term "low solvent form" is meant that the solvent content including the moisture content of a tobacco material is less than about 12 percent, based on the total weight of the tobacco material. For example, when the first solvent is essentially pure water, the moisture content of the tobacco material in low solvent form is less than about 12 weight percent. Generally, it is desirable to provide tobacco materials having a solvent content less than 10 weight percent; while tobacco materials having solvent contents in the range of about 2 weight percent to about 8 weight percent are particularly preferred. Extracted components in low solvent form have a generally solid form and often can resemble a dry powder, especially when the extract is spray dried.

Convenient methods for providing the extracted components in low solvent form include spray drying, freeze drying, belt drying, flash drying, or other such methods. It is particularly desirable to concentrate the liquid extract prior to spray drying or freeze drying the extract. Spray drying of the liquid extract is especially preferred. For purposes of this invention, spray drying is a one-step continuous process for removing a liquid from a solution and producing a dried particulate form of the extracted components within the solution by spraying a feed of the solution into a hot drying medium. A representative spray drying process is described in U.S. Pat. No. 3,398,754 to Tughan. For purposes of this invention, freeze drying is an indirect, batch or continuous process for removing the liquid from a solution and producing a dried form of the extracted components by freezing the solution and drying the solution in a frozen state through sublimation under high vacuum. A representative freeze drying process is described in U.S. Pat. No. 3,316,919 to Green. Methods and conditions for providing extracted materials in a low solvent or solid form (e.g., as a powder) will be apparent to the skilled artisan. Extracted tobacco materials having a high surface area granular or powder forms are particularly desirable, as subsequent extraction steps using the second solvent are normally quite efficient when a high surface area solid is subjected to extraction steps using the second liquid solvent.

The extracted components and the first solvent are contacted with a second solvent. The second solvent is different from the first solvent. The second solvent is a solvent which is employed under conditions such that the solvent does not have the ability to extract all of the components which are extracted by the first solvent while extracting some portion or fraction of those components extracted by the first solvent.

The solvent used for the second extraction can vary, and is any solvent suitable for supercritically extracting components from the first tobacco extract. In particular, the solvent is capable of being provided in a supercritical state, extracting at least a portion of the aqueously extracted tobacco components, and ultimately providing further isolated extracted tobacco components. Examples of solvents include carbon dioxide, n-propane, n-pentane, n-heptane, cyclohexane, n-hexanol, ethanol, n-pentanol, toluene, acetone, methyl acetate, diethylether, petroleum ethers, halogenated hydrocarbons such as dichloromethane and difluoroethane, and the like, as well as mixtures thereof.

The second solvent can be employed along with predetermined amounts of entrainers such as hydrocarbons (e.g., ethane, ethylene, propane or propylene), and the like. Such entrainers can be mixed with the second solvent for the supercritical extraction step, or such entrainers can be mixed with the liquid tobacco extract prior to the supercritical extraction step. Such entrainers are particularly useful when the second solvent is employed to perform an extraction of extracted tobacco components within the first solvent (e.g., as an aqueous tobacco extract).

The amount of extracted tobacco material which is contacted with the second solvent can vary. Typically, the weight of the solvent relative to the aqueously extracted tobacco components is great enough to provide efficient extraction of a significant amount of supercritically extracted components of tobacco. The amount of second solvent relative to the low solvent form tobacco extract or the aqueous tobacco extract depends upon factors such as type of solvent, the temperature and pressure at which the supercritical extraction is performed, the type of tobacco which is being processed, the manner in which contact of the aqueous tobacco extract and supercritical solvent is conducted, and other such factors.

The conditions under which the second extraction is performed can vary. Typical temperatures are above the critical temperature of the particular solvent. The solvent/tobacco mixture can be agitated or otherwise manipulated (e.g., stirred) in order to increase the rate at which extraction occurs. For example, conditions can be provided so as to provide good diffusion of the supercritical solvent within the aqueous tobacco extract or within the tobacco extract which is in a solid or low solvent form.

The materials or components which are extracted by the second solvent can vary. The particular materials which are extracted often depend upon the properties of the particular solvent as well as the extraction conditions. Depending upon the tobacco type, composition of the aqueous extract, the supercritical solvent and extraction conditions, it is possible to ultimately obtain flavorful tobacco essences having high contents of certain tobacco flavors.

The second solvent and extracted components are removed from the extraction vessel and isolated from one another. The extracted components also are separated from any entrainers which may be employed. The manner of isolation can vary, and the particular conditions for isolation depend upon the solvent and optional entrainer. However, it is convenient to employ conventional separation means such as depressurization of the solvent and entrained tobacco components, lowering the temperature of the solvent and entrained tobacco components, employing collection or absorption beds, or the like. Depending upon the degree of depressurization, the degree of temperature change or the type of absorption bed employed, it is possible to obtain a fractionated supercritical tobacco extract.

As used herein, the term "isolate" in referring to the isolation of extracted components relative to the solvent is meant that the extracted components are separated from the solvent to yield the extracted components in a concentrated form. In particular, extracted components in concentrated form are isolated by removing a majority or essentially all of the solvent from the solvent/extracted component mixture. Highly preferred isolation operations involve removing as much of the solvent as possible thereby yielding a concentrated extract essentially free of that solvent. As such, highly concentrated extracts of tobacco materials essentially free of the solvent are obtained without the loss of significant amounts of tobacco volatiles.

If desired, the aqueous extract which has been subjected to the supercritical extraction step can be collected and isolated. For example, the aqueous extract is concentrated using a spray drying method or the like, to provide a tobacco fraction having a low moisture content. As such, there can be provided a concentrated aqueous extract of tobacco which has had certain amounts of components removed therefrom using a supercritical extraction process.

If desired, the solid extract which has been subjected to supercritical extraction steps can be collected, isolated and employed for use in the manufacture of smokable materials. As such, there can be provided a concentrated tobacco extract which has had certain amounts of components removed therefrom using a supercritical extraction process.

The process of the present invention provides a unique method for producing tobacco extracts using a two-stage extraction process while minimizing or eliminating interaction between the first and second solvents. As the first and second extraction conditions are different from one another, a certain amount of the initial extract is left within the first solvent after the second extraction is complete. Thus, depending upon the extraction solvents and the extraction conditions, the composition of the ultimate concentrated extract can be selectively altered.

The concentrated supercritical extracts and supercritically extracted non-concentrated liquid extracts are useful as flavors for cigarettes and other smoking articles. In particular, the concentrated extracts and liquid extracts can be applied to other tobacco materials. For example, when tobacco material in strip or cut filler form is processed according to this invention, the concentrated extracts can be applied to the spent materials from the first stage extraction, particularly after the spent materials have been dried to a moisture level of less than about 15 weight percent. Manners and methods for drying and processing spent materials from aqueous extraction processes will be apparent to the skilled artisan. Other forms of tobacco smoke, such as tobacco dust and stems, also can be extracted using the first solvent and the spent materials can be employed to produce a reconstituted tobacco material. For example, the spent materials which remain after the tobacco is extracted using the first solvent can be processed into a sheet-like form (e.g., using a papermaking type process), and the concentrated extracts or liquid extracts can be reapplied (i.e., as such or in a diluted form) to the spent materials.

The resulting smokable material having supercritical tobacco extracts or spent tobacco extracts which remain after supercritical extraction processing steps are complete then can be employed in cigarette manufacture. Alternatively, the concentrated supercritical extracts or the spent tobacco extracts which remain after supercritical extraction processing steps can be employed as flavors in those smoking articles described in U.S. Pat. No. 4,708,151 to Shelar; U.S. Pat. No. 4,714,082 to Banerjee et al; and U.S. Pat. No. 4,756,318 to Clearman et al.

The following examples are provided in order to further illustrate various embodiments of the invention but should not be construed as limiting the scope thereof. Unless otherwise noted, all parts and percentages are by weight.

EXAMPLE 1

Aged Burley tobacco in cut filler form is extracted in a stainless steel tank at a concentration of about 1 pound of tobacco per gallon of water. The extraction is conducted at ambient temperature (e.g., about 20° C.) while mechanically agitating the mixture over about a 1 hour period. The admixture is centrifuged to remove essentially all suspended solids. The aqueous extract is concentrated in a thin film evaporator to a concentration of about 30 percent dissolved solids. Thin film evaporation conditions are such that water is evaporated from the extract while loss of volatiles is minimized. The concentrated aqueous extract then is spray dried by continuously pumping the aqueous solution to an Anhydro size No. 1 spray dryer. The dried powder is collected at the outlet of the dryer. The inlet temperature of the spray dryer is about 215° C., and the outlet temperature is about 82° C.

The spray dried material is a brown, powdery material, and has a moisture content of about 6 percent to about 8 percent.

The spray dried material is further extracted using the high pressure apparatus shown generally in FIG. 2 suitably equipped with pressure gauges, shut off valves, check valves and metering valves.

The spray dried tobacco material is redissolved in water (i.e., 100 g spray dried tobacco in 500 g water). The aqueous extract is placed in 1 liter alloy steel extraction cylinder which is available as Autoclave Part No. TP0250SL15 from Autoclave Engineering, Inc., Erie, Pa. A tube equipped with a glass frit extends into the extraction cylinder.

Carbon dioxide is pumped from a storage tank using a Haskel Model AGT-62/152 pump through the glass frit into the extraction cylinder such that the carbon dioxide bubbles through the aqueous extract. The pressure within the extraction cylinder is increased to about 3,000 psig, and the extraction cylinder is maintained at a temperature of about 65° C. The carbon dioxide is allowed to flow through the cylinder at the rate of about 0.5 cfm (cubic feet per minute), while the pressure of about 3,000 psig therein is maintained. The extraction under such supercritical conditions is maintained for about 2 hours such that about 60 cubic feet of carbon dioxide is passed through the cylinder.

The carbon dioxide which exits the cylinder is depressurized to atmospheric pressure by manipulation of the metering valves, and the extracted tobacco components entrained in the carbon dioxide are collected in a 300 ml stainless steel separator vessel. The carbon dioxide then is vented.

The residue or essence which is collected is a homogeneous, viscous, jelly-like, semi-solid material having a dark brown color, and displays a strong tobacco aroma.

EXAMPLE 2

A flue-cured tobacco in cut filler form and having a nicotine content of about 4 percent is extracted in a stainless steel tank at a concentration of about 1 pound of tobacco per gallon of water. The extraction is conducted at ambient temperature (e.g., about 20° C.) while mechanically agitating the mixture over about a 1 hour period. The admixture is centrifuged to remove essentially all suspended solids. The aqueous extract is concentrated in a thin film evaporator to a concentration of about 30 percent dissolved solids. Thin film evaporation conditions are such that water is evaporated from the extract while loss of volatiles (including nicotine) is minimized. The concentrated aqueous extract then is spray dried by continuously pumping the aqueous solution to an Anhydro size No. 1 spray dryer. The dried powder is collected at the outlet of the dryer. The inlet temperature of the spray dryer is about 215° C., and the outlet temperature is about 82° C.

The spray dried material is a brown, powdery material, and has a moisture content of about 6 percent to about 8 percent, and a nicotine content of about 8 percent.

The spray dried material is further extracted using the high pressure apparatus shown generally in FIG. 2 suitably equipped with pressure gauges, shut off valves, check valves and metering valves.

A 594 g sample of the spray dried material is charged into an alloy steel tubular vessel which has porous end caps of 20 micron pore size. The spray dried extract remains in the vessel without use of substrates or carriers; and the porous nature of the vessel allows passage of solvent therethrough. The vessel containing the spray dried material is positioned into a 4 liter alloy steel extraction cylinder which is available as Autoclave Part No. TP0250SL15 from Autoclave Engineering, Inc., Erie, Pa. Carbon dioxide is pumped from a storage tank using a Haskel Model AGT-62/152 pump into the extraction cylinder. The pressure within the extraction cylinder is increased to about 5,000 psig, and the extraction cylinder is maintained at a temperature between about 65° C. and about 75° C. The carbon dioxide is allowed to flow through the cylinder at the rate of about 0.45 cfm (cubic feet per minute), while the pressure of about 5,000 psig therein is maintained. The extraction under such supercritical conditions is maintained for about 16.75 hours such that about 358 cubic feet of carbon dioxide is passed through the cylinder.

The carbon dioxide which exits the cylinder is depressurized to atmospheric pressure by manipulation of the metering valves, and the extracted tobacco components entrained in the carbon dioxide are collected in a 300 ml stainless steel separator vessel.

The residue or essence which is collected is a homogeneous, viscous, jelly-like, semi-solid material having a dark brown color, and displays a strong tobacco aroma. The essence has a weight of about 11.3 g and has a nicotine content of about 56 percent. The semi-solid material has a relatively sharp softening point between about 30° C. and about 50° C.

EXAMPLE 3

A Burley tobacco in cut filler form and having a nicotine content of about 4 percent is extracted in a stainless steel tank at a concentration of about 1 pound of tobacco per gallon of water. The extraction is conducted at ambient temperature (e.g., about 20° C.) while mechanically agitating the mixture over about a 1 hour period. The admixture is centrifuged to remove essentially all suspended solids. The aqueous extract is concentrated in a thin film evaporator to a concentration of about 30 percent dissolved solids. Thin film evaporation conditions are such that water is evaporated from the extract while loss of volatiles (including nicotine) is minimized. The concentrated aqueous extract then is spray dried by continuously pumping the aqueous solution to an Anhydro size No. 1 spray dryer. The dried powder is collected at the outlet of the dryer. The inlet temperature of the spray dryer is about 215° C., and the outlet temperature is about 82° C.

The spray dried material is a brown, powdery material, and has a moisture content of about 6 percent to about 8 percent, and a nicotine content of about 8 percent.

The spray dried material is further extracted using the high pressure apparatus shown generally in FIG. 2 suitably equipped with pressure gauges, shut off valves, check valves and metering valves.

A 454 g sample of the spray dried material is charged into an alloy steel tubular vessel which has porous end caps of 20 micron pore size. The spray dried extract remains in the vessel without use of substrates or carriers; and the porous nature of the vessel allows passage of solvent therethrough. The vessel containing the spray dried material is positioned into a 4 liter alloy steel extraction cylinder which is available as Autoclave Part No. TP0250SL15 from Autoclave Engineering, Inc., Erie, Pa. Carbon dioxide is pumped from a storage tank using a Haskel Model AGT-62/152 pump into the extraction cylinder. The pressure within the extraction cylinder is increased to about 5,000 psig, and the extraction cylinder is maintained at a temperature between about 65° C. and about 75° C. The carbon dioxide is allowed to flow through the cylinder at the rate of about 0.45 cfm, while the pressure of about 5,000 psig therein is maintained. The extraction under such supercritical conditions is maintained for about 17.5 hours such that about 305.4 cubic feet of carbon dioxide is passed through the cylinder.

The carbon dioxide which exits the cylinder is depressurized to atmospheric pressure by manipulation of the metering valves, and the extracted tobacco components entrained in the carbon dioxide are collected in a 300 ml stainless steel separator vessel.

The residue or essence which is collected is a homogeneous, viscous, jelly-like, semi-solid material having a dark brown color, and displays a strong tobacco aroma. The essence has a weight of about 13.8 g and has a nicotine content of about 73 percent. The semi-solid material has a relatively sharp softening point between 30° C. and about 50° C.

What is claimed is:

1. A process for providing a tobacco extract, the process comprising:

a) extracting components from tobacco material with a first solvent having an aqueous character thereby yielding a first solvent having extracted tobacco components there within and an unextracted tobacco residue;

b) separating the first solvent and extracted tobacco components within the first solvent from the unextracted residue; and then c) extracting tobacco components from the extracted tobacco components with a second solvent while the second solvent is in a supercritical state.

2. The process of claim 1 further comprising separating the tobacco components extracted by the second solvent from the second solvent.

3. The process of claim 1 or 2 whereby the first solvent is water.

4. The process of claim 1 or 2 whereby the second solvent comprises carbon dioxide.

5. The process of claim 3 whereby the second solvent comprises carbon dioxide.

6. The process of claim 1 or 2 whereby the first solvent and tobacco components extracted thereby are subjected to a solvent removal process thereby providing an extracted tobacco material having a first solvent content of less than about 25 weight percent, after step (b) but prior to step (c).

7. The process of claim 3 whereby the first solvent and tobacco components extracted thereby are subjected to a solvent removal process thereby providing an extracted tobacco material having a first solvent content of less than about 25 weight percent, after step (b) but prior to step (c).

8. The process of claim 1 or 2 whereby the first solvent and tobacco components extracted thereby are subjected to a spray drying process, after step (b) but prior to step (c).

9. The process of claim 3 whereby the first solvent and tobacco components extracted thereby are subjected to a spray drying process, after step (b) but prior to step (c).

10. The process of claim 1 or 2 whereby the tobacco components extracted in step (c) are applied to the unextracted residue of step (b).

11. The process of claim 3 whereby the tobacco components extracted in step (c) are applied to the unextracted residue of step (b).

12. The process of claim 1 or 2 whereby the tobacco components not extracted in step (c) are applied to the unextracted residue of step (b).

13. The process of claim 3 whereby the tobacco components not extracted in step (c) are applied to the unextracted residue of step (b).

14. A process for providing a tobacco extract, the process comprising:

a) extracting components from tobacco with a first solvent in liquid form thereby providing extracted tobacco components within the first solvent; and then b) extracting tobacco components from the extracted tobacco components within the first solvent with a second solvent while the second solvent is in a supercritical state; and then c) isolating tobacco components extracted by the second solvent from the second solvent.

15. The process of claim 14 whereby the first solvent has an aqueous character.

16. The process of claim 15 whereby the first solvent is water.

17. The process of claim 15 whereby the first solvent is a mixture of water and an alcohol.

18. The process of claim 15 whereby the components extracted in step (a) are subjected to a spray drying operation and then redissolved in the first solvent prior to step (b).

19. The process of claim 14, 15, 16, 17 or 18 whereby the second solvent comprises carbon dioxide.

20. The process of claim 14, 15, 16, 17 or 18 further comprising collecting and isolating extracted tobacco components remaining in the first solvent after extraction thereof using the second solvent is complete.

21. The process of claim 14, 15, 16, 17 or 18 whereby the extracted components resulting from step (b) are isolated from the second solvent by converting the fluid from a supercritical state to a subcritical state.

22. The process of claim 14, 15 or 16 further comprising applying isolated extracted components resulting from step (c) to spent tobacco material resulting from step (a).

23. The process of claim 20 whereby the spent tobacco material is dried to a moisture level of less than about 15 weight percent prior to the time that the isolated extracted components are applied thereto.

24. A process for providing a tobacco extract, the processing comprising:

(a) extracting components from tobacco with a first solvent in liquid form thereby providing extracted tobacco components within the first solvent; and then (b) extracting tobacco components from the extracted tobacco within the first solvent with a second solvent while the second solvent is in a supercritical state; and then (c) isolating tobacco components not extracted by the second solvent from the first solvent.

25. The process of claim 24 whereby the first solvent has an aqueous character.

26. The process of claim 25 whereby the first solvent is water.

27. The process of claim 25 whereby the first solvent is a mixture of water and an alcohol.

28. The process of claim 25 whereby the components extracted in step (a) are subjected to a spray drying operation and then redissolved in the first solvent prior to step (b).

29. The process of claim 25 further comprising isolating tobacco components not extracted by the second solvent and then applying the resulting isolated components to spent tobacco material resulting from step (a).

30. The process of claim 24, 25, 26 or 27 whereby the second solvent comprises carbon dioxide.

31. A process for providing a tobacco extract, the processing comprising:

(a) extracting components from tobacco material with a first solvent having an aqueous character, (b) providing the extracted components in a low solvent form, (c) extracting components from the extracted components of step (b) with a second solvent under supercritical conditions, and (d) isolating extracted components resulting from step (c) from the second solvent.

32. The process of claim 31 whereby the first solvent is water.

33. The process of claim 31 whereby the first solvent is a mixture of water and an alcohol.

34. The process of claim 31 whereby the components extracted in step (a) are subjected to a spray drying operation.

35. The process of claim 31 whereby the first solvent is water, the components extracted in step (a) are subjected to a spray drying operation, and the resulting extracted components thereby provided have a moisture content of less than 10 weight percent.

36. The process of claim 31, 32, 33, 34 or 35 whereby the second solvent is carbon dioxide.

37. The process of claim 31, 32, 33, 34 or 35 further comprising collecting and isolating residual components not extracted in step (d).

38. The process of claim 31 further comprising applying isolated extracted components resulting from step (d) to spent tobacco material resulting from step (a).

39. The process of claim 38 whereby the spent tobacco material is dried to a moisture level of less than about 15 weight percent prior to the time that the isolated extracted components are applied thereto.

40. The process of claim 31 further comprising collecting and isolating residual components not extracted in step (c) and then applying the residual components to spent tobacco material resulting from step (a).

41. The process of claim 40 whereby the spent tobacco material is dried to a moisture level of less than about 15 weight percent prior to the time that the isolated residual components are applied thereto.

42. A process for providing a tobacco extract, the processing comprising:

(a) extracting components from tobacco material with a first solvent having an aqueous character, (b) providing the extracted components in a low solvent form, (c) extracting components from the extracted components of step (b) with a second solvent under supercritical conditions, and (d) isolating residual components not supercritically extracted in step (c).

43. The process of claim 42 whereby the first solvent is water.

44. The process of claim 42 whereby the first solvent is a mixture of water and an alcohol.

45. The process of claim 42 whereby the components extracted in step (a) are subjected to a spray drying operation.

46. The process of claim 42 whereby the first solvent is water, the components extracted in step (a) are subjected to a spray drying operation, and the resulting extracted components thereby provided have a moisture content of less than 10 weight percent.

47. The process of claim 42 further comprising collecting and isolating residual components not extracted in step (c) and then applying the residual components of step (d) to spent tobacco material resulting from step (a).

* * * * *

UNITED STATES PATENT AND TRADEMARK OFFICE

CERTIFICATE OF CORRECTION

PATENT NO. : 5,435,325

DATED : July 25, 1995

INVENTOR(S) : William L. Clapp et al.

It is certified that error appears in the above-indentified patent and that said Letters Patent is hereby corrected as shown below:

In the Abstract:

Line 12, after "essence." insert --The extracted tobacco components are separated from the supercritical fluid by depressurizing the fluid, lowering the temperature of the fluid, or by employing collection or absorption beds.--.

Line 12, after "The" insert --resulting--.

Signed and Sealed this

Sixteenth Day of April, 1996

Bruce Lehman

*Attest:*

BRUCE LEHMAN

*Attesting Officer*

*Commissioner of Patents and Trademarks*